US010562546B2

(12) United States Patent
Dolnik et al.

(10) Patent No.: US 10,562,546 B2
(45) Date of Patent: Feb. 18, 2020

(54) MECHANISM FOR OPERATING A RAILCAR DISCHARGE GATE ASSEMBLY

(71) Applicants: John E. Dolnik, Pleasant Prairie, WI (US); Christopher C. Gaydos, Burlington, WI (US)

(72) Inventors: John E. Dolnik, Pleasant Prairie, WI (US); Christopher C. Gaydos, Burlington, WI (US)

(73) Assignees: MINER ENTERPRISES, INC., Geneva, IL (US); POWERBRACE CORPORATION, Kenosha, WI (US)

( * ) Notice: Subject to any disclaimer, the term of this patent is extended or adjusted under 35 U.S.C. 154(b) by 151 days.

(21) Appl. No.: 15/837,152

(22) Filed: Dec. 11, 2017

(65) Prior Publication Data

US 2019/0176855 A1 Jun. 13, 2019

(51) Int. Cl.
*B61D 19/00* (2006.01)
*B61D 7/02* (2006.01)

(52) U.S. Cl.
CPC ..... *B61D 19/005* (2013.01); *B61D 7/02* (2013.01)

(58) Field of Classification Search
CPC ..... B65D 90/00; B65D 90/54; B60P 1/56; B61D 7/00–36; B61D 19/005
See application file for complete search history.

(56) References Cited

U.S. PATENT DOCUMENTS 115,688 A * 6/1871 Bowman ..... A01O 5/06 111/134
168,047 A * 9/1875 Perry ..... A47J 37/07 126/7
270,848 A * 1/1883 Rosebrugh ..... A63H 33/3016 181/138
2,738,737 A 3/1956 Zimmer
2,914,000 A * 11/1959 Mulcahy ..... B61D 7/16 105/250
4,359,176 A * 11/1982 Johnson ..... B61D 7/28 105/240

(Continued)

OTHER PUBLICATIONS

International Searching Authority; International Search Report regarding International PCT patent application No. PCT/US2018/062878; dated Feb. 6, 2019,. 2 sheets.

(Continued)

*Primary Examiner* — Jason C Smith
(74) *Attorney, Agent, or Firm* — Law Office of John W. Harbst

(57) ABSTRACT

A mechanism for operating a discharge gate assembly mounted on a railcar. The gate assembly includes a frame defining a discharge opening, a door slidably positioned on the frame for a generally horizontal range of movements between a closed position and an open position. An operating shaft assembly is mounted on the frame for rotation about a fixed axis and is operably coupled to the door such that the door moves in response to rotation of the operating shaft assembly. The mechanism for operating the discharge gate assembly includes a mount carried by and with the railcar and an actuator carried by the mount outside a range of travel of the slidable door. A force transfer mechanism is operated by the actuator for rotating the operating shaft assembly to slidably move the door between the closed and open positions in response to operation of the actuator.

22 Claims, 12 Drawing Sheets

(56) References Cited

U.S. PATENT DOCUMENTS

| | | | | |
|---|---|---|---|---|
| 5,359,942 | A * | 11/1994 | Ward | B61D 7/30 105/240 |
| 2005/0168047 | A1* | 8/2005 | Grier | B60P 1/56 298/27 |
| 2010/0270848 | A1* | 10/2010 | Heider | B60P 1/56 298/27 |
| 2015/0115688 | A1* | 4/2015 | Goedken | B60P 1/56 298/27 |
| 2019/0176855 | A1* | 6/2019 | Dolnik | B61D 19/005 |

OTHER PUBLICATIONS

International Searching Authority; Written Opinion of the International Searching Authority regarding International PCT patent application No. PCT/US2018/062878; dated Feb. 6, 2019; 7 sheets.

* cited by examiner

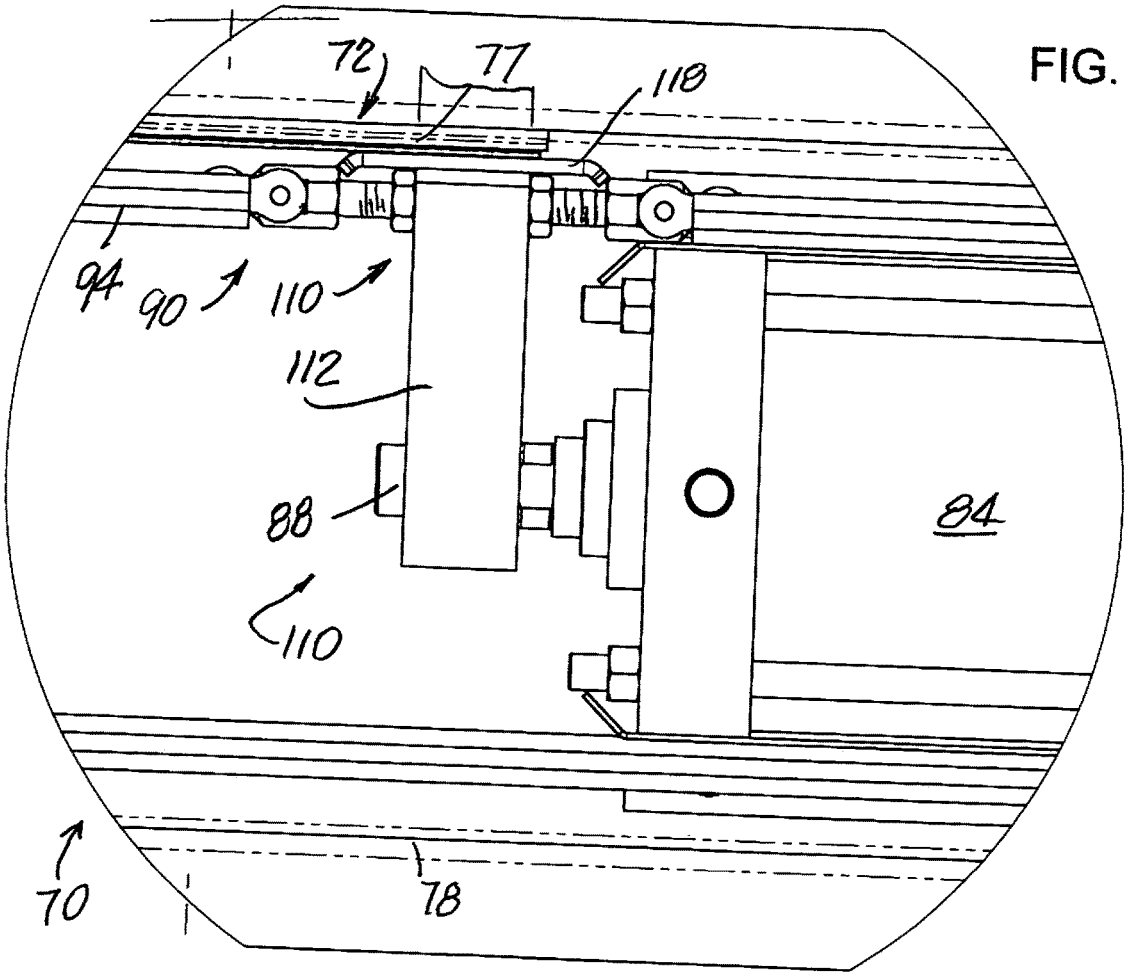
FIG. 11
FIG. 12
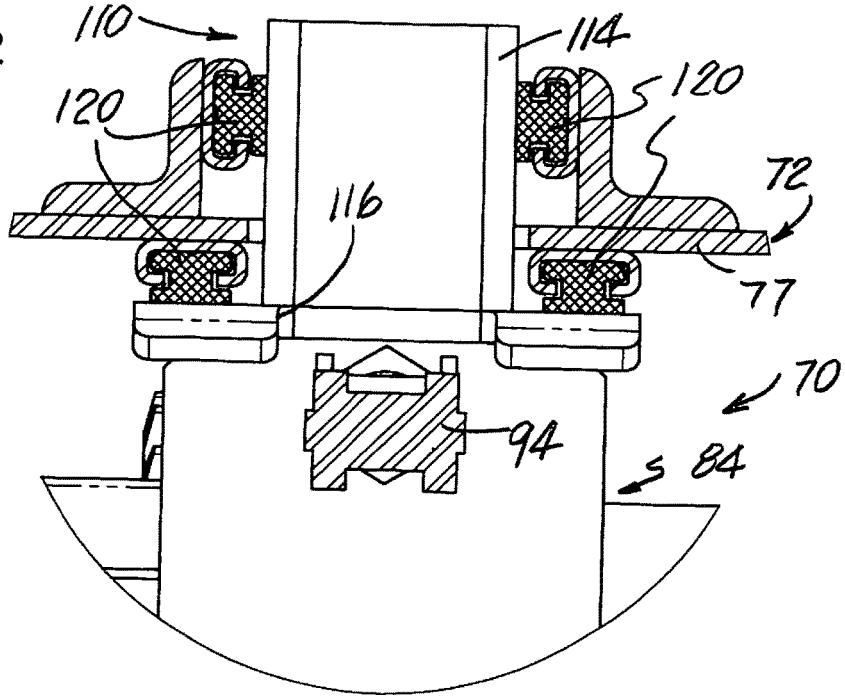

MECHANISM FOR OPERATING A RAILCAR DISCHARGE GATE ASSEMBLY

FIELD OF THE INVENTION DISCLOSURE

The present invention disclosure relates to railroad hopper cars and, more particularly, to a mechanism for operating a railcar discharge gate assembly.

BACKGROUND OF THE INVENTION DISCLOSURE

A typical railroad hopper car includes an elongated frame supported toward opposite ends on trucks for movement over rails. A hopper is mounted on the frame and includes a plurality of open bottom chutes from which commodity within the hopper is gravitationally discharged. To control the gravitational flow of material from the hopper, the opening at the bottom of each chute has a gate assembly arranged in general registry therewith.

Each gate assembly includes a rigid frame defining a discharge opening arranged in registry with the opening at the bottom of each chute on the hopper. A door is slidably positioned on the frame for a generally horizontal range of movements. More specifically, the door is mounted on the frame for sliding movements between a closed position, wherein the door closes the discharge opening, and an open position. In the open position, the door is disposed to one side of the opening. As will be appreciated by those skilled in the art, commodity within the hopper exerts or places an appreciable columnar load on the slide door when the slide door is in the closed position.

On many gate assemblies, movement of the door between open and closed positions is effected by an operating shaft assembly carried by the frame of the gate assembly for rotation about a fixed axis. The operating shaft assembly is operably coupled to the slide door of the gate assembly. The operating shaft assembly typically includes an elongated operating shaft which is supported at opposed ends by capstans. In one form, a rack and pinion assembly converts rotational movements of the operating shaft assembly into linear displacement of the door depending upon the direction of rotation of the operating shaft assembly.

Each capstan of the operating shaft assembly is typically configured to receive either an elongated bar or a free end of a high-powered torque driver. In one instance, the elongated bar is inserted through the capstan and the capstan is rotated to effect movement of the slide door. In the other instance, the free end of the high-powered torque driver is inserted into a free and open end of the capstan and the driver is operated to forcibly rotate the capstan and thereby move the slide door, depending upon the direction the door opener mechanism, between closed and open positions.

As will be appreciated by those skilled in the art, time is typically of the essence regarding unloading of a railroad hopper car. As such, in many railroad hopper car unloading situations, the railcar does not come to a complete stop during the unloading process. Accordingly, and in those situations when an elongated bar is used to rotate the operating shaft assembly to effect opening of the slide door, an operator needs to walk alongside the railcar to effect rotation of the operating shaft. Of course, the elongated bar is usually relocated several times with respect to the capstan to effect sufficient rotation of the operating shaft assembly to move the slide door from a closed position to an open position. Requiring an operator to walk alongside a moving railcar while having to repeatedly locate, insert, rotate, remove, relocate, reinsert and again rotate the elongated bar relative to an opening in a capstan can and often does prove to be problematic for all concerned.

To facilitate movements of the high-powered torque driver into operable engagement with the free end of the capstan, it is common for such drivers to be mounted on wheels. As such, the driver can be moved toward and away from the gate as required. As the railcar continues to move during the unloading process, however, the driver is problematically dragged along in a direction not in line with the wheels on the driver.

Alternatively, the driver is mounted on wheels which allow the high-powered torque driver to move along a path extending generally parallel with the direction of movements of the railcar. In this alternative arrangement, the free or distal end of the driver is movable toward and away from the free end of the capstan.

With either high-powered torque driver arrangement, the free or distal end of the driver tends to wear and result in significant damage to the open end of the capstan. Of course, when the free and open end of the capstan becomes worn, use of the high-powered torque driver is no longer feasible whereby requiring manual use of the elongated bar to move the slide door accompanied by the problems associated therewith.

Thus, there is need and continuing desire for a mechanism for operating a railcar discharge gate assembly which is carried by and moves with the railcar and is designed to eliminate many of the known problems associated with operating a slide door of a railcar gate assembly between closed and open positions.

SUMMARY

In view of the above, and in accordance with one aspect of this invention disclosure, there is provided a mechanism for operating a discharge gate assembly mounted on a railcar. The gate assembly includes a frame defining a discharge opening, a door slidably positioned on the frame for generally horizontal range of movements between a closed position, wherein the door closes the discharge opening, and an open position, wherein the door is disposed to one side of the discharge opening. An operating shaft assembly is mounted on the frame for rotation about a fixed axis and is operably coupled to the door such that the door moves in response to rotation of the operating shaft assembly. The mechanism for operating the discharge gate assembly includes a mount carried by and with the railcar and an actuator carried by the mount outside a range of travel of the slidable door. A force transfer mechanism is operated by the actuator for rotating the operating shaft assembly to slidably move the door between the closed and open positions in response to operation of the actuator.

In one form, the actuator of the railcar discharge gate assembly operating mechanism is carried by the mount in a substantially horizontal position. Preferably, the actuator includes a driver having one end joined to the mount and a second linearly distendable end joined to the force transfer mechanism.

In a preferred form, the force transfer mechanism includes at least one of a chain or belt arranged for movements in a loop in both forward and backward directions. That is, the force transfer mechanism preferably includes a first chain or belt arranged in a loop and entrained about first and second horizontally spaced members carried by the mount for movements in both forward and backward directions, and a second chain or belt arranged in a loop and entrained about the first member and the axis of the operating shaft assembly for imparting rotation to the operating shaft assembly and movements to the slide door upon actuation by the actuator. Preferably, the mount and actuator include cooperating instrumentalities for limiting displacement of the actuator during operation of the railcar discharge gate assembly operating mechanism.

According to another aspect of this invention disclosure, there is provided a mechanism for operating a discharge gate assembly mounted on a railcar. The gate assembly includes a frame defining a discharge opening, and a door slidably positioned on the frame for generally horizontal range of movements between a closed position, wherein the door closes the discharge opening, and an open position, wherein the door is disposed to one side of the opening. An operating shaft assembly is mounted on the frame for rotation about a fixed axis and is operably coupled to the door. The mechanism for operating the discharge gate assembly includes a mount carried by and with the railcar, a power source on the railcar, and an actuator carried by the mount outside a range of travel of the slidable door. Circuitry is arranged between the power source and the actuator for controlling operation of the actuator. Moreover, a force transfer mechanism is operated by the actuator for rotating the operating shaft assembly to slidably move the door between the closed and open positions in response to operation of the actuator.

The actuator for the operating mechanism is carried on the mount preferably in a substantially horizontal position. The actuator for the operating mechanism preferably comprises one of at least: a hydraulic cylinder; a pneumatic cylinder; and, an electric liner actuator. In one form, the actuator for the operating mechanism includes a linearly distendable pneumatic cylinder, with the circuitry being configured to selectively control the pneumatic cylinder, and with the circuitry including an airflow valve configured to control the air supplied to the pneumatic cylinder. Such air flow valve includes: a first operating position providing an airflow to the pneumatic cylinder to positively move the slide door of the gate assembly in a first direction; a second operating position providing an airflow to the pneumatic cylinder to positively move the slide door of the gate assembly in a second direction, opposite from the first direction; and, a third operating position restricting airflow from the pneumatic cylinder. In this form, the airflow valve is biased toward the third operating position.

In a preferred embodiment, the force transfer mechanism of the operating mechanism includes at least one of a chain or belt arranged for movements in a loop in both forward and backward directions. In one form, the force transfer mechanism of the operating mechanism includes first and second linearly spaced members respectively carried for rotation about first and second fixed axes on the mount, a first chain or belt arranged in a loop and entrained about first and second spaced members for movements in both forward and backward directions, and a second chain or belt arranged in a loop and entrained about the first member and the axis of the operating shaft assembly for imparting movements to the slide door. In one form, the mount and actuator include cooperating instrumentalities for limiting displacement of the actuator during operation of the railcar discharge gate assembly operating mechanism.

According to another feature of this invention disclosure, there is provided a mechanism for operating a discharge gate assembly mounted on a railcar. The gate assembly includes a frame defining a discharge opening, a door slidably positioned on the frame for a generally horizontal range of movements between a closed position, wherein the door closes the discharge opening, and an open position, wherein the door is disposed to one side of the discharge opening. An operating shaft assembly is mounted on the frame for rotation about a fixed axis. The operating shaft assembly is operably coupled to the door. In this aspect of the invention disclosure, the operating mechanism includes a drive mechanism carried by and with the railcar and which is operably coupled to the sliding door through the operating shaft assembly and configured to allow movement of the slide door between the closed and open positions thereof. A pneumatic actuator is coupled to the drive mechanism and is operable to power the drive mechanism so that slide door is forcibly moved between the closed and open positions. According to this aspect of the invention disclosure, the pneumatic actuator is selectively coupled to a source of compressed air on the railcar.

In one form, a mount is carried by the railcar, and wherein the pneumatic actuator is carried on the mount in a substantially horizontal position. The actuator of the operating mechanism preferably includes a driver having one end joined to the mount and a second linearly distendable end joined to the drive mechanism.

Preferably, the drive mechanism of the operating mechanism includes at least one of a chain or belt arranged for movements in a loop in both forward and backward directions. In a preferred embodiment, the drive mechanism of the operating mechanism includes a first chain or belt arranged in a loop and entrained about first and second spaced members carried by the mount for movements in both forward and backward directions and a second chain or belt arranged in a loop and entrained about the first member and the axis of the operating shaft assembly for imparting rotation to the operating shaft assembly and movements to the slide door upon actuation by the pneumatic actuator. In one form, the mount and the second linearly distendable end of the pneumatic actuator include cooperating instrumentalities for limiting displacement of the pneumatic actuator during operation of the drive mechanism. In a preferred embodiment, the pneumatic actuator is selectively coupled to a source of compressed air through valve structure which controls directional operation of the actuator.

DESCRIPTION OF THE DRAWINGS

FIG. 11 is an enlarged side elevational view of that area encircled in phantom lines in FIG. 8;

FIG. 12 is an enlarged view of that area encircled in phantom lines in FIG. 10.

DETAILED DESCRIPTION

Figure 1:
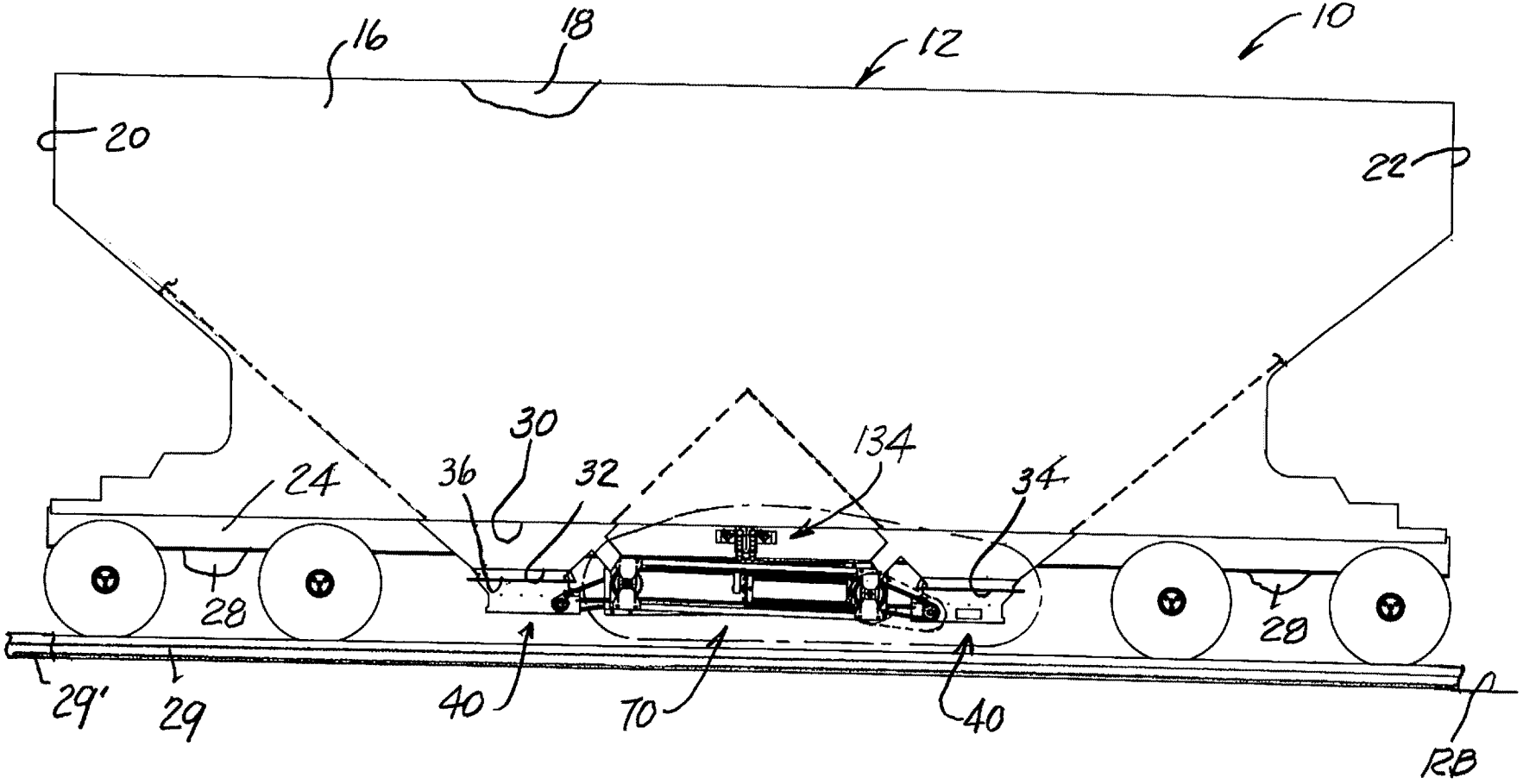
FIG. 1 is a side elevational view of a railroad hopper car embodying principals and teachings of this invention disclosure.

While this invention disclosure is susceptible of embodiment in multiple forms, there is shown in the drawings and will hereinafter be described a preferred embodiment, with the understanding the present disclosure is to be considered as setting forth an exemplification of the disclosure which is not intended to limit the disclosure to the specific embodiment illustrated and described.

Referring now to the drawings, wherein like reference numerals indicate like parts throughout the several views, there is shown in FIG. 1 a railroad hopper car, generally designated by reference numeral 10. Car 10 includes a walled enclosure or hopper 12 wherein materials or commodity can be stored and shipped. The hopper or enclosure 12 has a generally rectangular configuration, in plan, toward an upper end thereof and includes upstanding rigid side walls 16 and 18 rigidly joined to upstanding end walls 20 and 22 (FIG. 1). The walled enclosure 12 is carried on a conventional mobile frame 24. Opposed ends of the walled enclosure or hopper 12 and frame 24 are supported in a well known manner by trucks 28 shown pictorially in FIG. 1. As shown, wheels of each truck 28 engage and roll over a pair of laterally spaced rails 29, 29' on a road bed RB.

In the embodiment illustrated for exemplary purposes in FIG. 1, a bottom 30 of the walled enclosure or hopper 12 is provided with at least two longitudinally spaced discharge areas 32 and 34 from whence material in the hopper 12 is gravitationally discharged. It will be appreciated, however, the bottom 30 of the walled enclosure 12 can be provided with more than two discharge areas without detracting or departing from the novel spirit and broad scope of this invention disclosure. In the illustrated embodiment, the discharge areas 32 and 34 are substantially identical relative to each other and, thus, only discharge area 32 will be discussed in detail.

Each discharge area at the bottom of hopper 12 includes a discharge opening 36 for allowing or permitting material in the hopper 12 to be rapidly and gravitationally discharged in a controlled manner therefrom. In the embodiment illustrated by way of example in FIGS. 1 and 2, each discharge opening 36 defined by hopper 12 has a generally rectangular marginal edge configuration.

An appropriately sized gate or door assembly 40 is arranged in operable combination with each discharge opening comprising the respective discharge area at the bottom of the walled enclosure 12. Again, it should be appreciated, the number of discharge gates arranged in operable combination with the hopper 12 will be a function of the number of discharge openings associated with each discharge area on the hopper 12.

In the illustrated embodiment, the gate assembly operably associated with the discharge area 32 is substantially identical relative to the discharge gate assembly operably associated with the discharge area 34. In one form, each gate assembly is a conventional 13"×42" inch gate assembly sold by Miner Enterprises, Inc. under Model Number MICE 10513; although other conventional gate assemblies would equally suffice. Preferably, each gate assembly is disposed to gravitationally discharge commodity from the hopper 12 between the rails 29, 29' (FIG. 1). In the illustrated embodiment, the gate assembly 40 for each discharge area is preferably disposed in substantially longitudinally aligned relation relative to each other.

Figure 2:
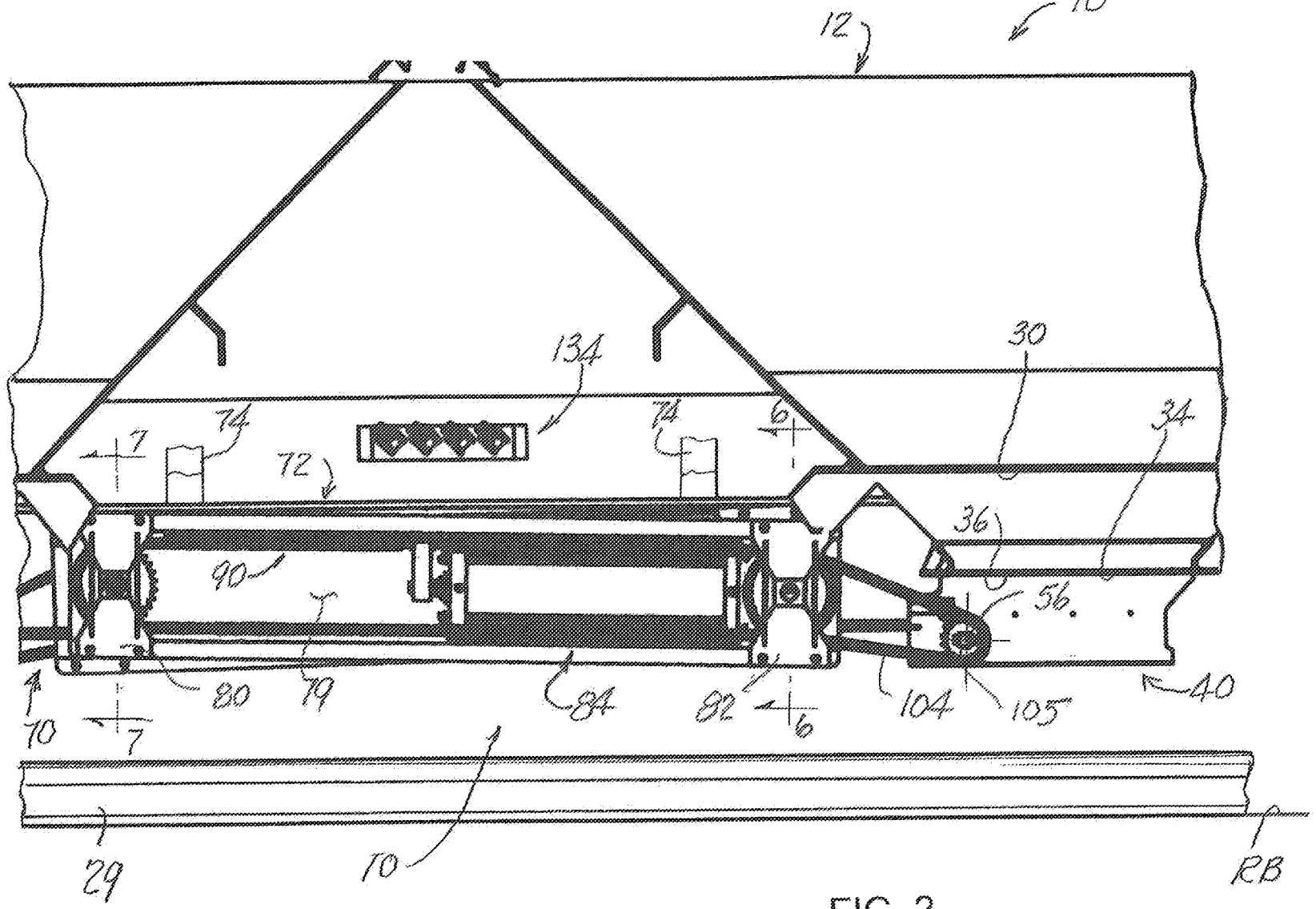
FIG. 2 is an enlarged fragmentary side elevational view of that area encircled in phantom lines in FIG. 1.

In the illustrated embodiment, and since the gate assembly associated with each discharge area 32, 34 on car 10 are substantially similar to each other, only one gate assembly will be described in detail. As illustrated by way of example in FIGS. 3, 4 and 5, each gate assembly includes a rigid frame 42 preferably defining a generally rectangular discharge outlet 43 (FIG. 3) arranged in generally registry or material receiving relation with one of the discharge openings comprising one of the discharge areas on car 10 (FIG. 2). Frame 42 of gate assembly preferably includes four frame members 44, 45, 46 and 47 rigidly interconnected to each other in a generally rectangular pattern.

To facilitate mounting each gate assembly to suitable structure on hopper 12, each frame member 44, 45, 46 and 47 preferably terminates toward an upper end in an apertured and generally horizontal flange 48 extending outward and away from the discharge outlet of the respective gate. The apertured horizontal flanges 48 on the frame members 44, 45, 46 and 47 of each gate assembly are arranged in generally coplanar relationship relative to each other. Although the method of interface of each gate assembly with hopper 12 is illustrated as being with a generally horizontal flange 48, it will be appreciated the flanges 48 can also be slopped or angled to substantially correspond with the downward slope or angle of the depending chute wall of the hopper 12 (FIG. 1) leading to the respective discharge opening and be suitably secured thereto, as by welding or the like, without detracting or departing from the spirit and scope of this invention disclosure.

Each gate assembly furthermore includes a gate or slide door 50 mounted on the respective frame below the flanges 48 for sliding movement preferably in a generally horizontal path of travel or range of movements. The slide door 50 is movable anywhere between a first or closed position, wherein the door closes the discharge opening of the respective gate assembly, and a second or open position. In the open position, the slide door is disposed to one side of the respective discharge opening. When the slide door is in the second or open position, material is permitted to gravitationally exit or pass through the respective discharge outlet defined by the associated gate assembly from the respective discharge opening in the hopper 12. The materials gravitationally discharged from the hopper 12 are likely to predominately fall between the rails.

Each gate assembly further includes a suitable drive apparatus 54 for moving the respective slide door 50 (FIG. 3) thereof anywhere between and to the first or closed position and the second or open position and relative to the discharge outlet of the respective gate assembly. In one form, drive apparatus 54 includes an elongated operating shaft assembly 56 mounted on or carried by the frame 42 for rotation about a fixed axis 57. Typically, the operating shaft assembly 56 rotates between two and three complete revolutions about axis 57 as the door 50 moves between fully closed and fully open positions. Of course, and as will be appreciated, the operating shaft assembly 56 can rotate more or less about its fixed axis 57 as the slide door 50 moves between fully closed and fully open positions without detracting or departing from the spirit and broad scope of this invention disclosure.

In at least one embodiment, the operating shaft assembly 56 includes an elongated drive shaft 58 mounted for rotation on the frame 42 of the respective gate assembly about the fixed axis 57. A capstan 59 is arranged at opposed ends of and, in the illustrated embodiment, in non-rotatable relationship with the drive shaft 58. In the embodiment illustrated in FIGS. 3, 4 and 5, the operating shaft assembly 56 associated with each gate assembly is operably coupled to and moves the respective slide door thereof between positions and relative to the discharge outlet of the respective gate assembly as a result of rotation thereof about axis 57.

Figure 3:
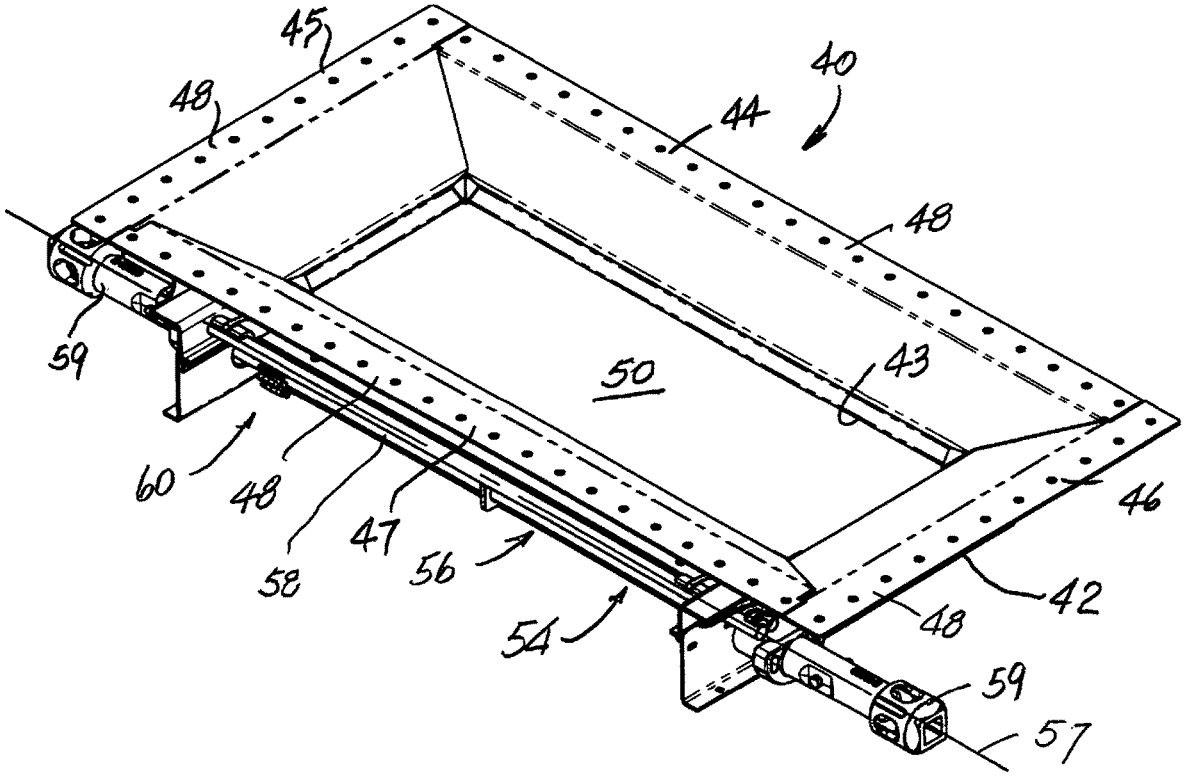
FIG. 3 is a perspective view of one form of railcar gate assembly with which the present invention disclosure finds utility.
Figure 4:
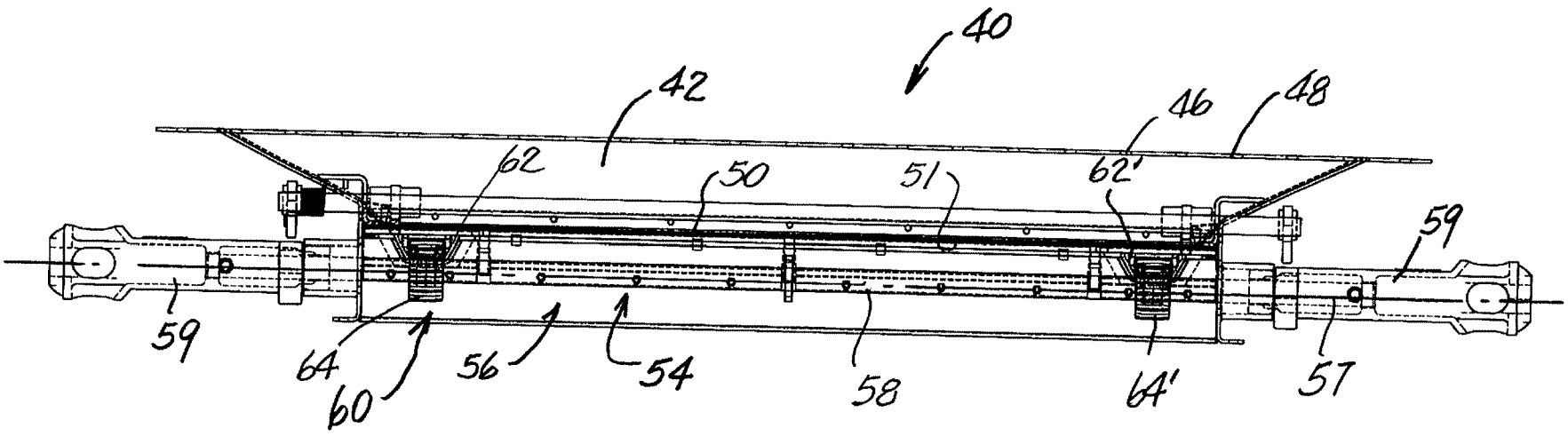
FIG. 4 is an end view of the railcar gate assembly illustrated in FIG. 3.

In the embodiment illustrated by way of example in FIGS. 3 and 4, a mechanism 60 is provided on each gate assembly for converting rotational movements of the operating shaft assembly 56 into linear movements of the slide door 50 (FIG. 3) of the respective gate assembly. In one form, such mechanism 60 includes a conventional rack and pinion assembly. It will be appreciated, however, other devices and/or mechanisms can be used for converting rotational movements of the operating shaft assembly 56 into linear movements of the slide door 50 of the respective gate assembly without detracting or departing from broad spirit and scope of this invention disclosure.

In the embodiment shown by way of example in FIG. 4, the rack and pinion assembly of each gate assembly preferably includes a pair of laterally spaced racks 62, 62' provided on an underside 51 of the respective slide door 50 to be moved along with a pair of laterally spaced pinion gears 64, 64' arranged in intermeshing relationship with the racks 62, 62', respectively. The pinion gears 64, 64' are arranged on the drive shaft 58 such that rotation of the operating shaft assembly 56 of the respective gate assembly results in linear displacement of the respective slide door in a direction dependent upon the rotational direction of shaft 58 about axis 57.

Figure 5:
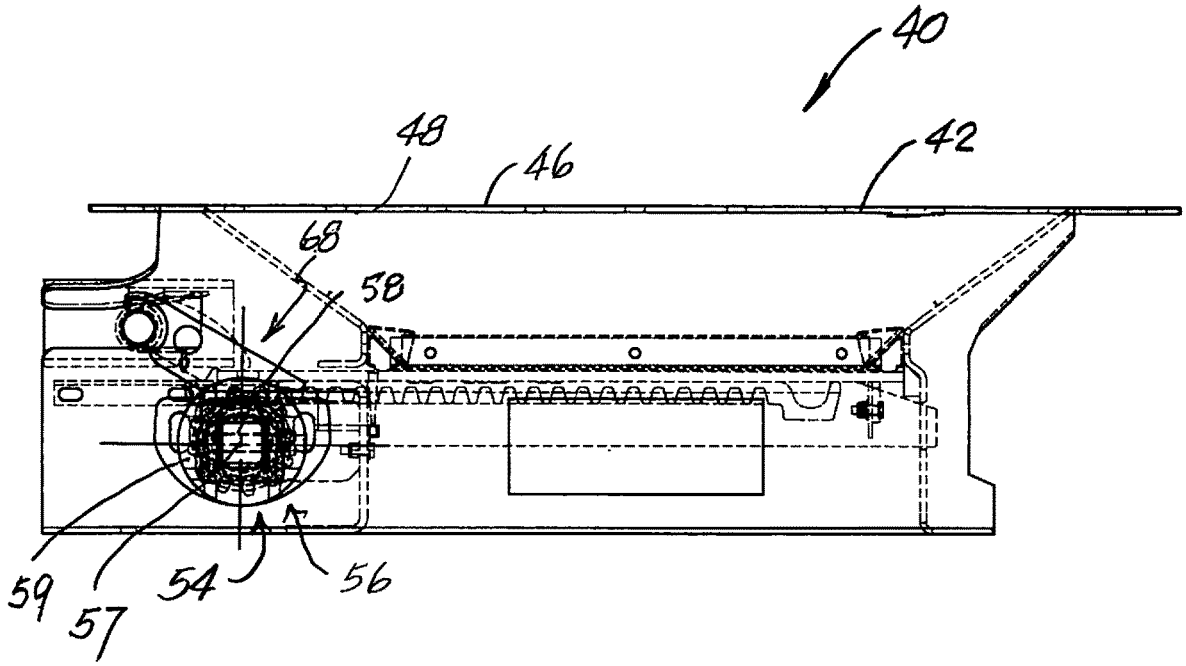
FIG. 5 is a side view of the railcar gate assembly illustrated in FIG. 3

In the embodiment illustrated by way of example in FIG. 5, each gate or door assembly 40 furthermore includes a lock assembly 68 for maintaining the slide door 50 (FIG. 3) in a closed position especially as the railcar 10 (FIG. 1) moves between locations. In one form, the lock assembly 68 embodies the teachings and principals of that disclosed in U.S. Pat. No. 5,829,359 to J. J. Dohr, et al.; the applicable portions of which are incorporated herein by reference.

According to this invention disclosure, each gate or door assembly 40 on hopper 12 furthermore includes a drive mechanism, generally indicated by reference numeral 70, for operating the gate assembly 40. In at least one embodiment illustrated by way of example in FIG. 2, the operating mechanism 70 associated with one gate or door assembly 40 is disposed or arranged to one lateral side of car 10 while the operating mechanism associated with the other gate or door assembly is disposed or arranged to an opposite lateral side of the car 10. Preferably, the operating mechanisms are substantially identical and, thus, only one operating mechanism will be described in detail.

Figure 6:
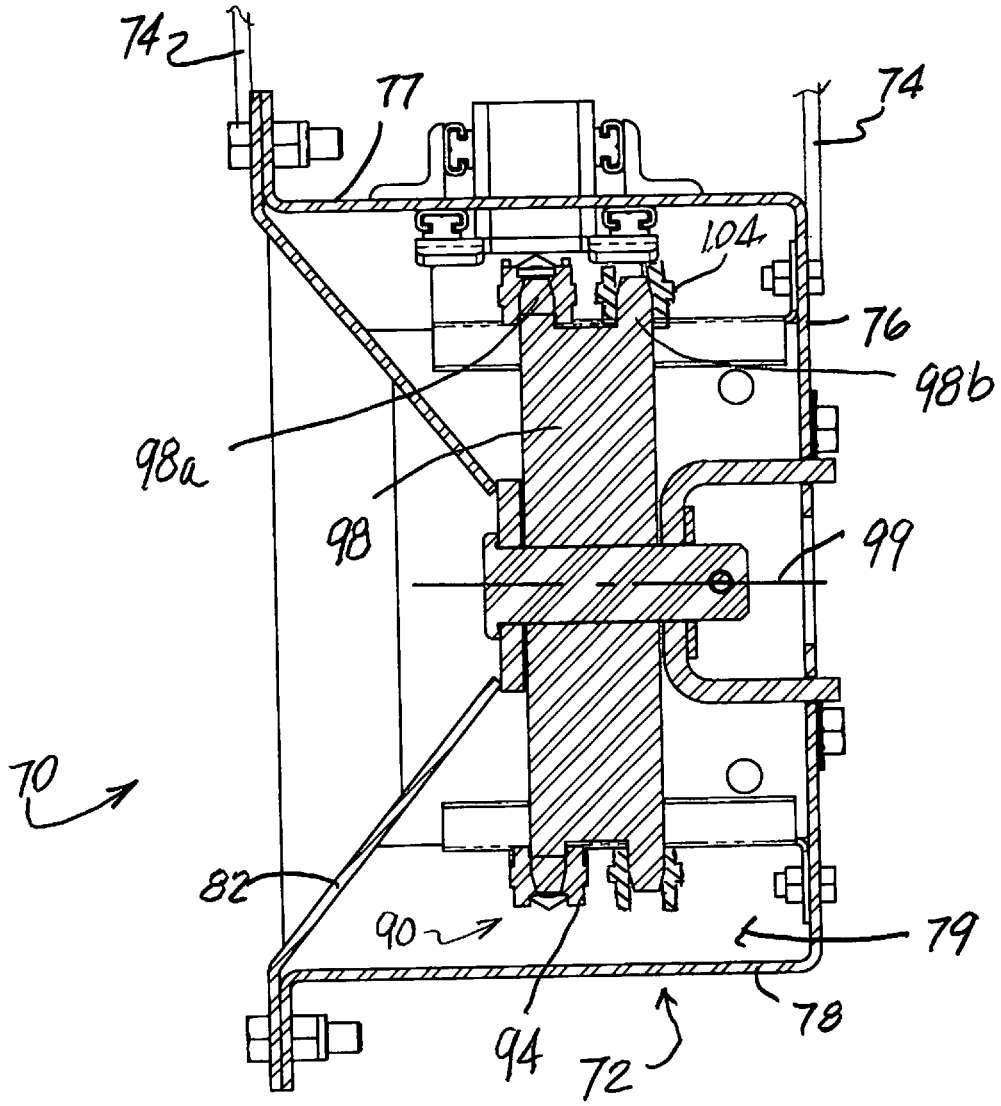
FIG. 6 is an enlarged sectional view taken along line 6-6 of FIG. 2.

In that embodiment illustrated by way of example in FIG. 6, each operating mechanism 70 has an elongated base or mount 72 carried by and with the railcar 10 (FIG. 1). As such, each operating mechanism 70 moves with the car 10 as the car 10 moves between locations. Preferably, and as illustrated in FIG. 2, mount 72 is carried in a substantially horizontal disposition. In one embodiment, mount 72 is suspended by suitable brackets 74 extending from either the car frame 24 or from hopper 12 on car 10. In the embodiment illustrated by way of example in FIGS. 6 and 7, mount 72 has a generally C-shaped cross-sectional configuration and includes a rigid back wall 76 with top and bottom walls 77 and 78, respectively, extending in the same direction relative to each other outwardly from the back wall 78 so as to define a protective cavity 79 therebetween. As illustrated, and toward opposed ends, the top and bottom walls 77 and 78 of mount 72 are rigidly interconnected by vertical braces 80 and 82.

Returning to FIG. 2, an actuator 84 is carried by the mount or base 72 outside a range of travel of the slidable door 50 (FIG. 3) of the respective gate assembly. The actuator 84 is preferably carried by the mount 72 in a substantially horizontal position and, preferably, within the protective cavity 79 defined by mount 72. In the embodiment illustrated by way of example in FIG. 8, the actuator 84 of each operating mechanism has one end 86 joined or operably coupled to the base or mount 72 and a second linearly distendable end 88. In a preferred embodiment, the actuator 84 comprises one of at least: a pneumatic cylinder, a hydraulic cylinder; and, an electric liner actuator. In the embodiment illustrated by way of example, the actuator 84 has a stroke length of at least 28.5 inches.

Figure 8:
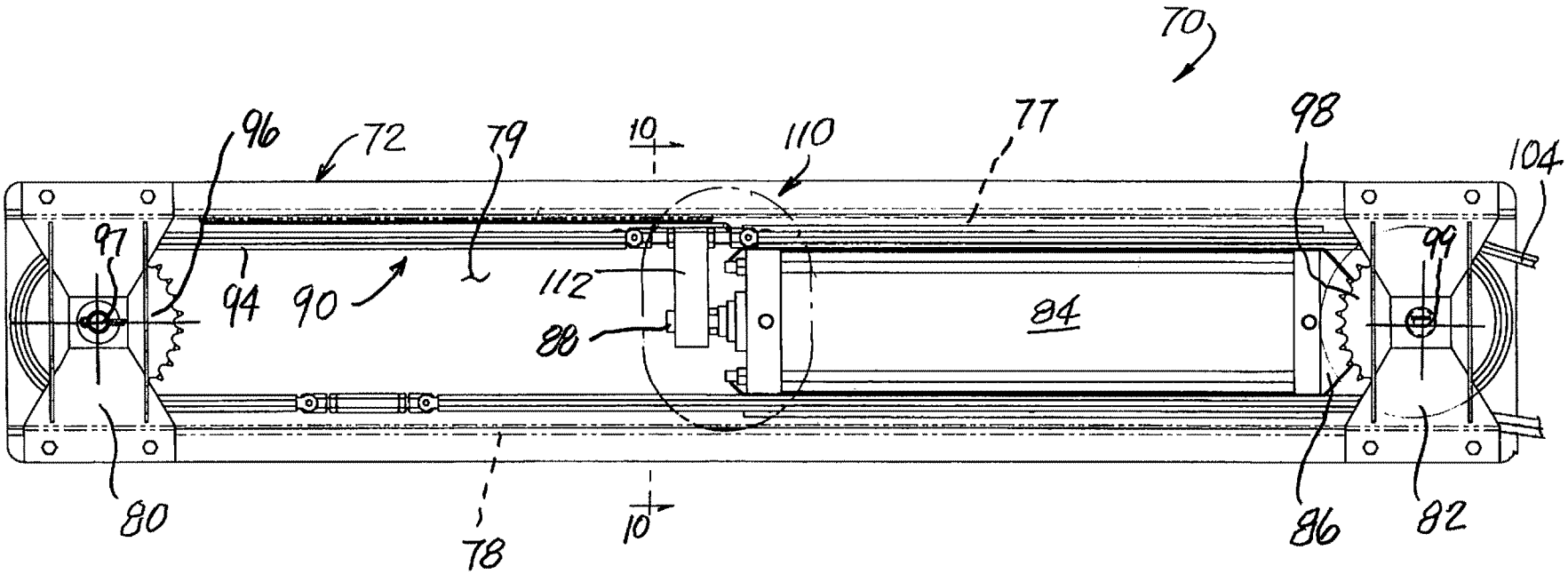
FIG. 8 is an enlarged fragmentary side elevational view of one form of mechanism for operating a discharge gate assembly according to the present invention disclosure

As shown by way of example in FIG. 8, a force transfer or drive mechanism 90 is operated by the actuator 84 for rotating the operating shaft assembly 56 (FIG. 3) of the respective gate assembly whereby slidably and positively moving the door 50 (FIG. 3) of the respective gate assembly between closed and open positions in response to operation of the actuator 84. Preferably, the force transfer mechanism 90 includes at least one of a chain assembly or belt assembly arranged for movements in a loop in both forward and backward directions.

Figure 7:
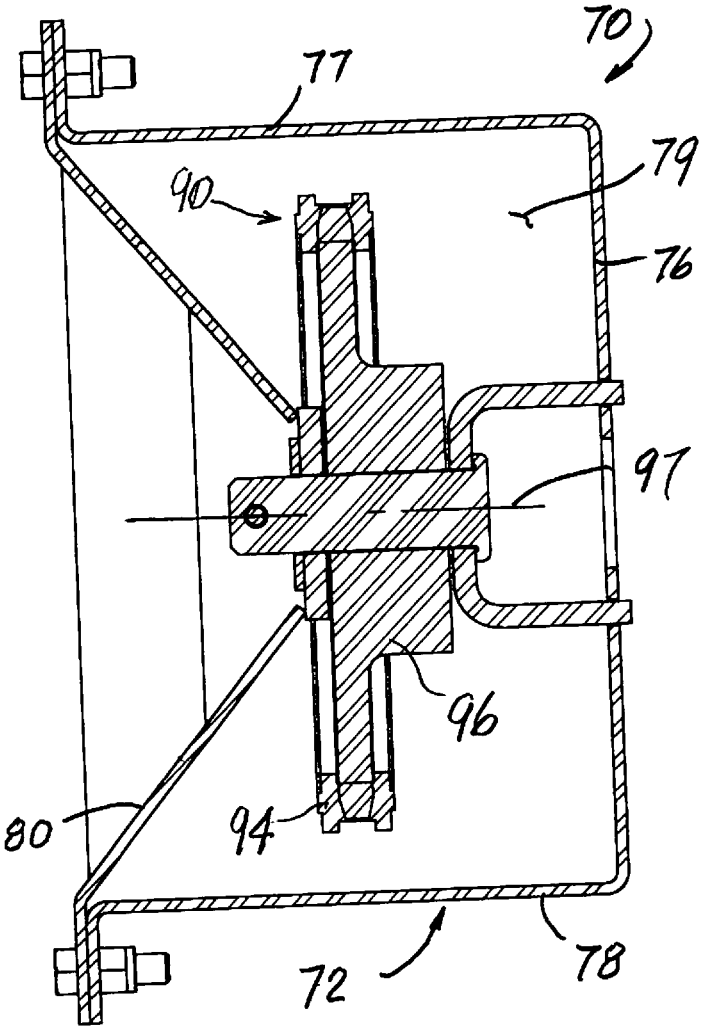
FIG. 7 is an enlarged sectional view taken along line 7-7 of FIG. 2.
Figure 9:
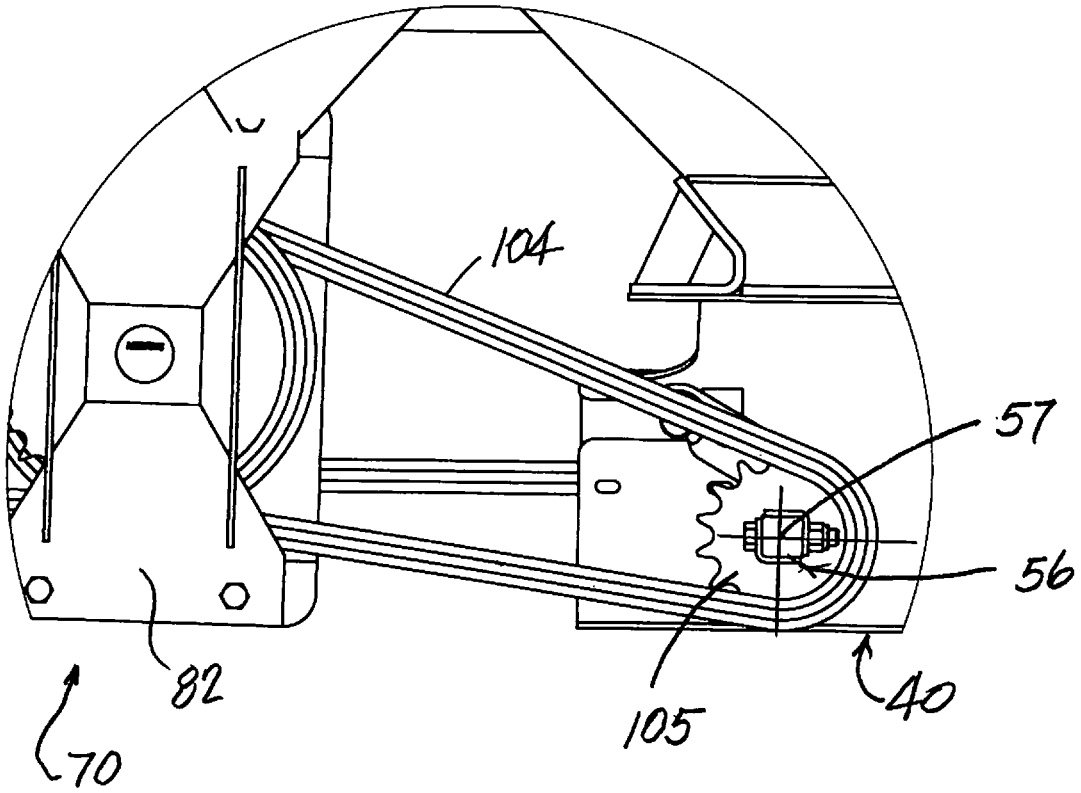
FIG. 9 is an enlarged fragmentary view of that area encircled in dash lines in FIG. 1

In the embodiment illustrated in FIGS. 6 and 9, the chain assembly or belt assembly of the force transfer mechanism 90 includes a first chain or belt 94 arranged in a loop and entrained about first and second horizontally spaced members 96 and 98, respectively, for movements in both forward and backward directions. As illustrated in FIGS. 7 and 8, the first and second horizontally spaced members 96 and 98, respectively, are arranged for free rotation about fixed axes 97 and 99, respectively, and are carried by mount 72. As shown in FIGS. 6 and 8, in a preferred embodiment, the chain assembly or belt assembly 92 of the force transfer mechanism 90 furthermore includes a second chain or belt 104 arranged in a loop and entrained about the rotatable member 98 and the axis 57 of the operating shaft assembly 56 (FIG. 9) for imparting rotation to the operating shaft assembly 56 and movements of the slide door 50 upon actuation of the actuator 84.

In the embodiment illustrated by way of example in FIG. 6, member 98 about which a portion of the first chain or belt 94 is entrained includes two side-by-side or laterally adjacent portions 98*a* and 98*b*. A portion of the first chain or belt 94 is entrained about portion 98*a* of member 98 while a portion of the second chain or belt 96 is entrained about portion 98*b* of member 96. As such, movements of the first chain or belt 94 by actuator 84 will likewise be transferred to movements of the second chain or belt 104.

As shown in FIGS. 2 and 9, another member 105 is arranged in operable combination with the operating shaft assembly 56. In the illustrated embodiment, member 105 is non-rotatably carried by the respective capstan 59 (FIG. 3) on the operating shaft assembly 56. A portion of the second chain or belt 104 is entrained about member 105 such that either forward or backward movements of the second chain or belt 104 will translate into rotation of the operating shaft assembly 56 about axis 57 which results in sliding movements of the door 50 upon actuation of the actuator 84. In this embodiment, the pitch diameters of members 98 and 105 have a ratio of about 2:1.

Figure 10:
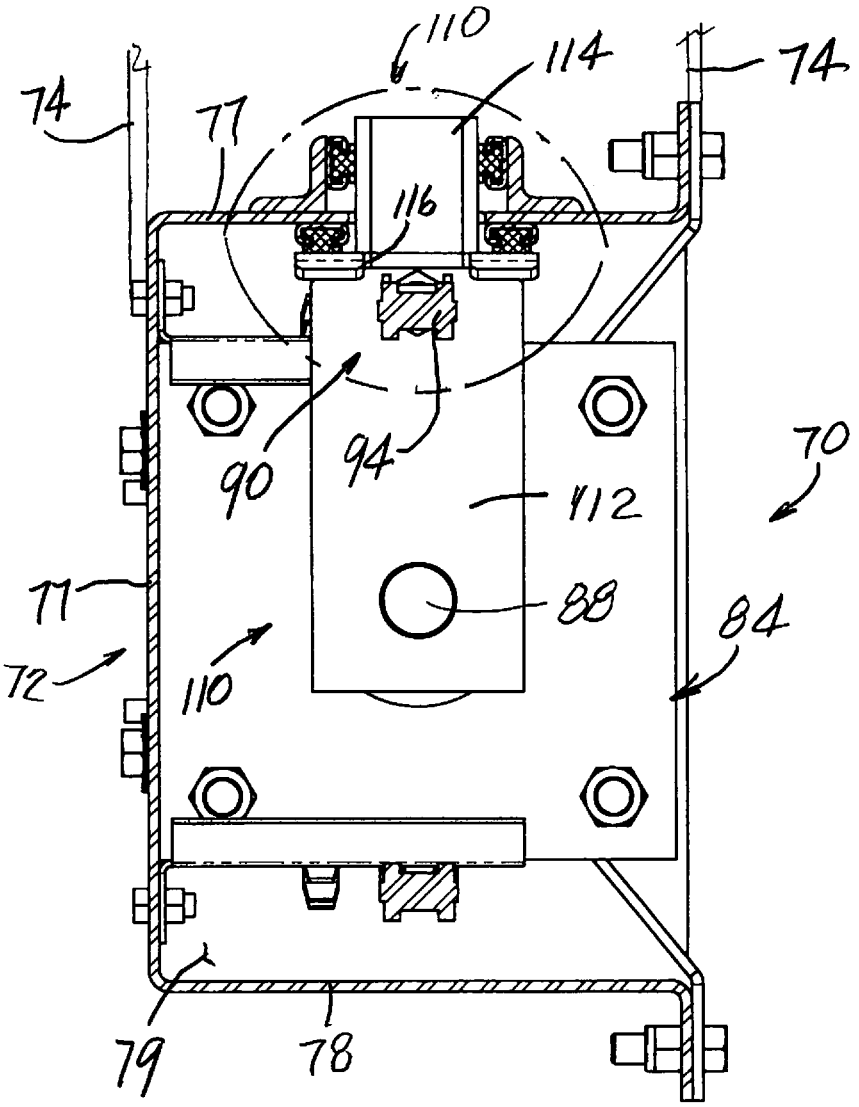
FIG. 10 is an enlarged sectional view taken along line 10-10 of FIG. 8.

The mount 72 and the actuator 84 preferably define cooperating instrumentalities 110 for limiting displacement of the second end of the actuator 84 during operation of the railcar discharge gate assembly operating mechanism 70. In the embodiment shown by way of example in FIGS. 10 and 11, such cooperating instrumentalities 110 include a connector 112 for operably coupling the second linearly distendable end 88 of actuator 84 to the force transfer mechanism 90. As shown by way of example in FIGS. 10 and 12, a vertical extension 114 on the connector 112 projects through an elongated slot or channel 116 which, in the illustrated embodiment, is defined by the top or upper wall 77 of the mount 72. In a preferred embodiment shown by way of example in FIG. 11, a slide plate 118, having a width greater than slot or channel 116 (FIG. 10) is carried by and moves with the extension 114 and underlies the top or upper wall 77 of the mount 72 to limit unwarranted displacement of actuator 84.

In the embodiment illustrated by way of example in FIG. 12, the cooperating instrumentalities 110 for limiting displacements of the second end of the actuator 84 during operation of the railcar discharge gate assembly operating mechanism 70 can further include material 120 operably disposed between the extension 114 and mount 72 as well as between the slide plate 118 and mount 72 to promote endwise sliding movements of the connector 112 relative to mount 72. In one form, material 120 includes ultra-high molecular weight plastic or nylon materials for establishing a relative low coefficient of friction between the extension 114 on connector 112 and mount 72 as well as between the slide plate 118 and mount 72 whereby promoting endwise sliding movements of the connector 112 relative to mount 72.

Figure 13:
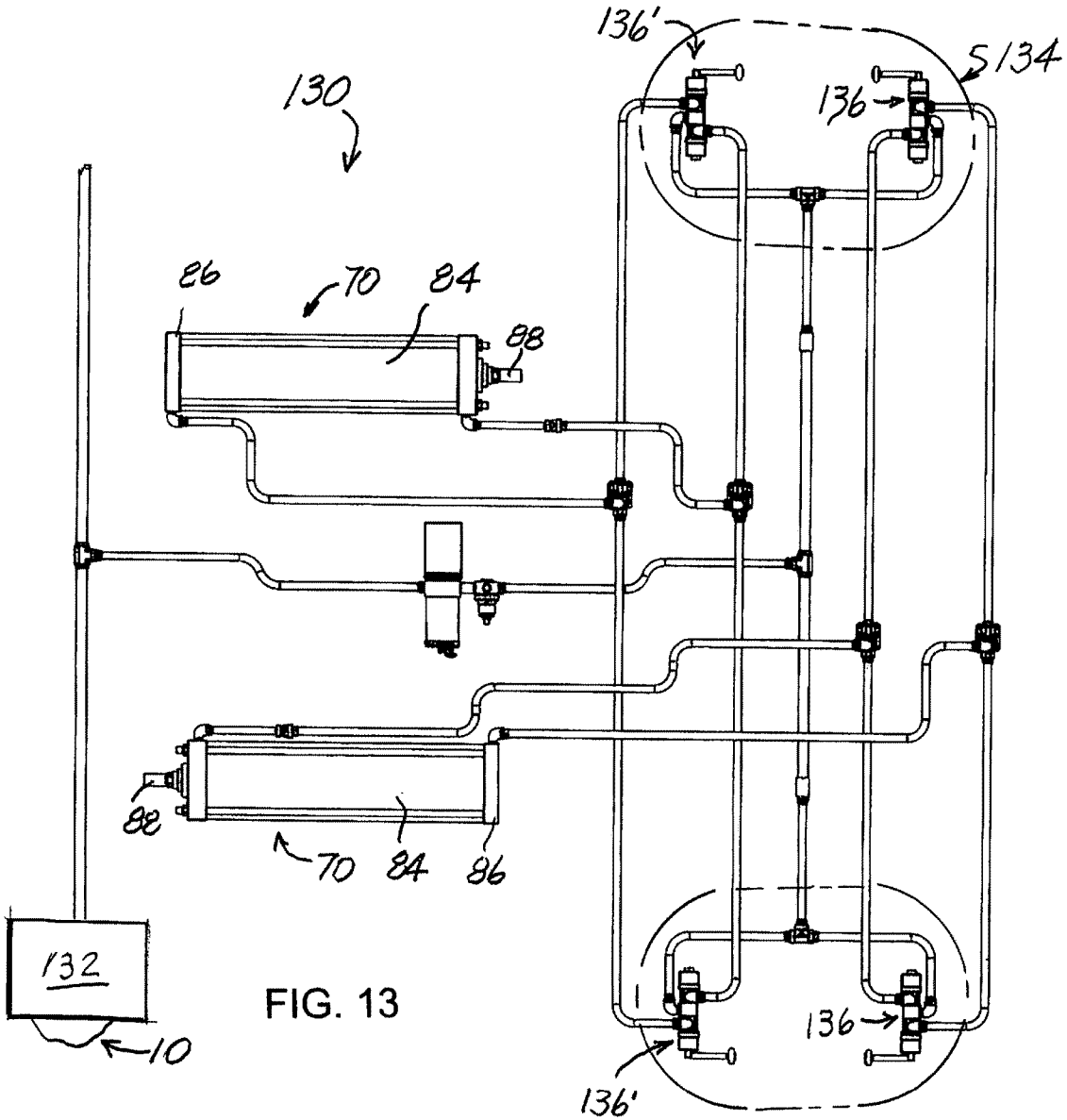
FIG. 13 is a schematic representation of one form of circuitry for controlling operation of the railcar discharge gate assembly operating mechanism.

Turning now to FIG. 13, there is schematically represented circuitry 130 for controlling operation of each railcar discharge gate assembly operating mechanism 70. Circuitry 130 is arranged between a suitable power source 132 on the railcar 10 and the actuator 84 of the drive mechanism 70 operably associated with each gate assembly on car 10. In the embodiment illustrated by way of example in FIG. 14, the power source 132 is a suitable source of compressed air on railcar 10.

In the embodiment illustrated by way of example in FIG. 13, circuitry 130 further includes valve structure 134 for controlling the directional operation of the actuator 84 operably associated with each operating mechanism 70 for each gate or door assembly 40 (FIG. 1) on railcar 10. In the embodiment illustrated by way of example in FIG. 14, and since the railcar 10 illustrated by way of example has two gate or door assemblies 40 operably associated with hopper 12 (FIG. 1), the valve structure 134 used to control the directional operation of the actuator 84 associated with each operating mechanism 70 for each gate or door assembly 40 (FIG. 1) on railcar 10 includes two valve assemblies 136, 136'. Suffice it to say, valve structure 134 is preferably configured such that the actuator 84 of each operating mechanism 70 positively maintains the slide door or gate 50 of each gate assembly (FIG. 3) in a closed position until the valve structure 134 is operated to positively move the slide door or gate 50 of the respective gate assembly toward an open position.

In the embodiment illustrated by way of example in FIG. 13, the actuator 84 operably associated with each operating mechanism 70 for each gate or door assembly 40 (FIG. 1) on railcar 10 is a pneumatic cylinder. As such, the valve structure 134 includes a conventional air flow valve configured to control the air supplied to the pneumatic cylinder of each operating mechanism 70. As will be readily understood to those skilled in the art, the air flow valve has: a first operating position providing an airflow to said pneumatic cylinder to positively move the slide gate in first direction; a second operating position providing an airflow to the pneumatic cylinder to positively move the slide gate in a second direction, opposite from the first direction; and, a third operating position restricting airflow from the pneumatic cylinder.

In one form of the invention disclosure, the valve structure 134 is structured to furthermore allow for manual operation of each gate assembly 40. It is within the spirit and scope of this invention disclosure, however, to furthermore allow valve structure 134 to be remotely controlled whereby facilitating discharge of material from the railcar 10 (FIG. 1) while the car 10 is moving along the rails.

From the forgoing, it will be observed numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated and discussed. Rather, this disclosure is intended to cover by the appended claims all such modifications and variations as fall within the spirit and scope of the claims.

What is claimed is:

1. A mechanism for operating a discharge gate assembly mounted on a railcar, with said gate assembly including a frame defining a discharge opening, a door slidably positioned on said frame for generally horizontal range of movements between a closed position wherein said door closes said discharge opening and an open position wherein said door is disposed to one side of said opening, an operating shaft assembly mounted on said frame for rotation about a fixed axis, with said operating shaft assembly being operably coupled to said door, said operating mechanism comprising:

a mount carried by and with said railcar;

a linear operated actuator carried by said mount outside a range of travel of said slidable door; and a force transfer mechanism operated by said actuator, with said force transfer mechanism being configured to transmute linear movements of said actuator into rotational movements of said operating shaft assembly whereby positively driving said door through said operating shaft assembly between said closed and open positions in response to operation of said actuator.

2. The railcar discharge gate assembly operating mechanism according to claim 1, wherein said linear operated actuator is carried by said mount in a substantially horizontal disposition.

3. The railcar discharge gate assembly operating mechanism according to claim 1, wherein said linear operated actuator has one end operably joined to said mount and a second linearly distendable end joined to said force transfer mechanism.

4. The railcar discharge gate assembly operating mechanism according to claim 1, wherein said force transfer mechanism includes at least one of a chain or belt arranged for movements in a loop in both forward and backward directions.

5. The railcar discharge gate assembly operating mechanism according to claim 1, wherein said mount and said linear operated actuator include cooperating instrumentalities for limiting displacement of said linear operated actuator during operation of said railcar discharge gate assembly operating mechanism.

6. A mechanism for operating a discharge gate assembly mounted on a railcar, with said gate assembly including a frame defining a discharge opening, a door slidably positioned on said frame for generally horizontal range of movements between a closed position wherein said door closes said discharge opening and an open position wherein said door is disposed to one side of said opening, an operating shaft assembly mounted on said frame for rotation about a fixed axis, with said operating shaft assembly being operably coupled to said door, said operating mechanism comprising:

a mount carried by and with said railcar;

an actuator carried by said mount outside a range of travel of said slidable door; and a force transfer mechanism operated by said actuator for rotating said operating shaft assembly to slidably move said door between said closed and open positions in response to operation of said actuator, wherein said force transfer mechanism includes a first chain or belt arranged in a loop and entrained about first and second linearly spaced members carried by said mount for movements in both forward and backward directions and a second chain or belt arranged in a continuous loop and entrained about said first member and the axis of said operating shaft assembly for imparting rotation to said operating shaft assembly and movements to said slide door upon actuation by said actuator.

7. A mechanism for operating a discharge gate assembly mounted on a railcar, with said gate assembly including a frame defining a discharge opening, a door slidably positioned on said frame for a range of movements between a closed position wherein said door closes said discharge opening and an open position wherein said door is disposed to one side of said opening, an operating shaft assembly mounted on said frame for rotation about a fixed axis, with said operating shaft assembly being operably coupled to said door, said operating mechanism comprising:

a mount carried by and with said railcar;

a power source on said railcar;

a linear operated actuator carried by said mount outside a range of travel of said slidable door, with said linear operated actuator being operably connected to said power source;

circuitry arranged between said power source and said linear operated actuator for controlling operation of said linear operated actuator; and a force transfer mechanism operated by said linear operated actuator, with said force transfer mechanism being configured to transmute linear movements of said actuator into rotational movements of said operating shaft assembly to drive said door through said operating shaft assembly between said closed and open positions in response to operation of said actuator.

8. The railcar discharge gate assembly operating mechanism according to claim 7, wherein said linear operated actuator is carried by said mount in a substantially horizontal disposition.

9. The railcar discharge gate assembly operating mechanism according to claim 7, wherein said linear operated actuator comprises one of at least: a hydraulic cylinder; a pneumatic cylinder; and, an electric actuator.

10. The railcar discharge gate assembly operating mechanism according to claim 7, wherein said force transfer mechanism includes at least one of a chain or belt arranged for movements in a loop in both forward and backward directions.

11. The railcar discharge gate assembly operating mechanism according to claim 7, wherein said mount and said linear operated actuator include cooperating instrumentalities for limiting displacement of said actuator during operation of said railcar discharge gate assembly operating mechanism.

12. A mechanism for operating a discharge gate assembly mounted on a railcar, with said gate assembly including a frame defining a discharge opening, a door slidably positioned on said frame for a range of movements between a closed position wherein said door closes said discharge opening and an open position wherein said door is disposed to one side of said opening, an operating shaft assembly mounted on said frame for rotation about a fixed axis, with said operating shaft assembly being operably coupled to said door, said operating mechanism comprising:

a mount carried by and with said railcar;

a power source on said railcar;

an actuator carried by said mount outside a range of travel of said slidable door, with said actuator being operably connected to said power source;

circuitry arranged between said power source and said actuator for controlling operation of said actuator; and a force transfer mechanism operated by said actuator for rotating said operating shaft assembly to slidably move said door between said closed and open positions in response to operation of said actuator, wherein said actuator includes a linearly distendable pneumatic cylinder, with said circuitry being configured to selectively control said pneumatic cylinder, and with said circuitry including an airflow valve configured to control the air supplied to said pneumatic cylinder.

13. The railcar discharge gate assembly operating mechanism according to claim 12, wherein said air flow valve has: a first operating position providing an airflow to said pneumatic cylinder to positively move said slide gate in first direction; a second operating position providing an airflow to said pneumatic cylinder to positively move said slide gate in a second direction, opposite from said first direction; and, a third operating position restricting airflow from said pneumatic cylinder.

14. The railcar discharge gate assembly operating mechanism according to claim 12, wherein said airflow valve is biased toward said third operating position.

15. A mechanism for operating a discharge gate assembly mounted on a railcar, with said gate assembly including a frame defining a discharge opening, a door slidably positioned on said frame for a range of movements between a closed position wherein said door closes said discharge opening and an open position wherein said door is disposed to one side of said opening, an operating shaft assembly mounted on said frame for rotation about a fixed axis, with said operating shaft assembly being operably coupled to said door, said operating mechanism comprising:

a mount carried by and with said railcar;

a power source on said railcar;

an actuator carried by said mount outside a range of travel of said slidable door, with said actuator being operably connected to said power source;

circuitry arranged between said power source and said actuator for controlling operation of said actuator; and a force transfer mechanism operated by said actuator for rotating said operating shaft assembly to slidably move said door between said closed and open positions in response to operation of said actuator, wherein said force transfer mechanism includes first and second linearly spaced members respectively carried by said mount for rotation about first and second fixed axes, a first chain or belt arranged in a loop and entrained about the first and second spaced members for movements in both forward and backward directions, and a second chain or belt arranged in a loop and entrained about said first member and the axis of said operating shaft assembly for imparting movements to said slide door.

16. A mechanism for operating a discharge gate assembly mounted on a railcar, with said gate assembly including a frame defining a discharge opening, a door slidably positioned on said frame for generally horizontal range of movements between a closed position wherein said door closes said discharge opening and an open position wherein said door is disposed to one side of said opening, an operating shaft assembly mounted on said frame for rotation about a fixed axis, with said operating shaft assembly being operably coupled to said door, said operating mechanism comprising:

a drive mechanism carried by and with said railcar and which is operably coupled to said sliding door through said operating shaft assembly;

a pneumatic linear operated actuator coupled to said drive mechanism and operable to power said drive mechanism; and wherein said drive mechanism is configured to transmute the linear movements of said actuator into rotational movements of said operating shaft such that said slide door is positively driven between the closed and open positions through said operating shaft assembly in response to actuation of said actuator, with said pneumatic actuator being selectively coupled to a source of compressed air on said railcar.

17. The railcar discharge gate assembly operating mechanism according to claim 16, further including a mount carried by said railcar, and wherein said pneumatic actuator is carried on said mount in a substantially horizontal position.

18. The railcar discharge gate assembly operating mechanism according to claim 16, wherein said actuator includes a driver having one end joined to said mount and a second linearly distendable end joined to said drive mechanism.

19. The railcar discharge gate assembly operating mechanism according to claim 18, wherein said mount and the second linearly distendable end of said pneumatic actuator include cooperating instrumentalities for limiting displacement of said pneumatic actuator during operation of said drive mechanism.

20. The railcar discharge gate assembly operating mechanism according to claim 16, wherein said pneumatic actuator is selectively coupled to the source of compressed air on said railcar through valve structure which controls directional operation of said actuator on said railcar.

21. A mechanism for operating a discharge gate assembly mounted on a railcar, with said gate assembly including a frame defining a discharge opening, a door slidably positioned on said frame for generally horizontal range of movements between a closed position wherein said door closes said discharge opening and an open position wherein said door is disposed to one side of said opening, an operating shaft assembly mounted on said frame for rotation about a fixed axis, with said operating shaft assembly being operably coupled to said door, said operating mechanism comprising:

a drive mechanism carried by and with said railcar and which is operably coupled to said sliding door through said operating shaft assembly and configured to allow movement of said slide door between the closed and open positions thereof, wherein said drive mechanism includes at least one of a chain or belt arranged for movements in a loop in both forward and backward directions; and a pneumatic actuator coupled to said drive mechanism and operable to power said drive mechanism so that slide door is forcibly moved between the closed and open positions, with said pneumatic actuator being selectively coupled to a source of compressed air on said railcar.

22. A mechanism for operating a discharge gate assembly mounted on a railcar, with said gate assembly including a frame defining a discharge opening, a door slidably positioned on said frame for generally horizontal range of movements between a closed position wherein said door closes said discharge opening and an open position wherein said door is disposed to one side of said opening, an operating shaft assembly mounted on said frame for rotation about a fixed axis, with said operating shaft assembly being operably coupled to said door, said operating mechanism comprising:

a drive mechanism carried by and with said railcar and which is operably coupled to said sliding door through said operating shaft assembly and configured to allow movement of said slide door between the closed and open positions thereof, wherein said drive mechanism includes a first chain or belt arranged in a loop and entrained about first and second linearly spaced members carried by said mount for movements in both forward and backward directions and a second chain or belt arranged in a loop and entrained about said first member and the axis of said operating shaft assembly for imparting rotation to said operating shaft assembly and movements to said slide door upon actuation by said pneumatic actuator; and a pneumatic actuator coupled to said drive mechanism and operable to power said drive mechanism so that slide door is forcibly moved between the closed and open positions, with said pneumatic actuator being selectively coupled to a source of compressed air on said railcar.

* * * * *